United States Patent [19]

Mansfield et al.

[11] Patent Number: 4,837,563

[45] Date of Patent: Jun. 6, 1989

[54] GRAPHICS DISPLAY SYSTEM FUNCTION CIRCUIT

[75] Inventors: Robert L. Mansfield; Alexander K. Spencer, both of Austin; Joe C. St. Clair, Round Rock, all of Tex.

[73] Assignee: International Business Machine Corporation, Armonk, N.Y.

[21] Appl. No.: 13,841

[22] Filed: Feb. 12, 1987

[51] Int. Cl.[4] ..... G09G 1/00

[52] U.S. Cl. ..... 340/732; 340/724; 340/747; 364/521

[58] Field of Search ..... 377/52, 44, 49; 340/724, 726, 723, 732, 744, 747, 749, 750, 789, 798, 799; 364/518, 521, 719

[56] References Cited

U.S. PATENT DOCUMENTS

| | | | |
|---|---|---|---|
| 4,272,808 | 6/1981 | Hartwig | 364/521 |
| 4,458,330 | 7/1984 | Imsand et al. | 340/747 |
| 4,545,063 | 10/1985 | Kamimaru | 377/44 |
| 4,580,236 | 4/1986 | Tsujioka et al. | 340/732 |
| 4,626,839 | 12/1986 | O'Malley | 340/724 |
| 4,644,340 | 2/1987 | Holloway et al. | 340/724 |
| 4,644,503 | 2/1987 | Bantz et al. | 364/521 |
| 4,663,731 | 5/1987 | Ikegami et al. | 340/724 |
| 4,667,306 | 5/1987 | Smith | 340/724 |
| 4,706,205 | 11/1987 | Akai et al. | 340/723 |
| 4,706,213 | 11/1987 | Bandai | 340/724 |

OTHER PUBLICATIONS

*IBM Technical Disclosure Bulletin,* vol. 28, No. 5, Oct. 1985, "Circuit for Updating Bit Map-Memory of a Display Adapter", pp. 2240–2243.

*IBM Technical Disclosure Bulletin,* vol. 27, No. 8, Jan. 1985, "Raster Graphics Drawing Hardware", pp. 4618–4622.

*IBM Technical Disclosure Bulletin,* vol. 28, No. 6, Nov. 1985, "Graphic Bit-Blt Copy Under Mask", pp. 2721–2724.

*Fundamentals of Interactive Computer Graphics,* by James D. Foley and Andries VanDam, published by Addison-Wesley Publishing Company, 1982, pp. 433–435.

*Primary Examiner*—John W. Caldwell, Sr.
*Assistant Examiner*—Jeffery A. Brier
*Attorney, Agent, or Firm*—Thomas E. Tyson

[57] ABSTRACT

In a graphics display system a counter for performing either a line drawing algorithm or a bit block transfer algorithm where the counter is performing the bit block transfer algorithm includes a first counter circuit counting from a first initial state to a first predetermined value and a second counter circuit counting from a second initial state to a second predetermined value. The second counter counts in response to the first counter reacing to its predetermined value. In support of a line drawing algorithm, the counter circuit reconfigures itself to provide a first counter to count from its first initial state to the first predetermined value and a second counter to compute a parameter value and to conditionally count from a second initial value to a second predetermined value in response to the value of this parameter. These counters are connected to an addressing circuit to increment the addresses in performance of the algorithms. This counter circuit capability increases the speed at which line draw functions and bit block transfer functions can be accomplished in a graphics display system processor.

10 Claims, 10 Drawing Sheets

| | | | |
|---|---|---|---|
| 3 | 2 | 1 | 0 |
| 7 | 6 | 5 | 4 |
| 11 | 10 | 9 | 8 |
| 15 | 14 | 13 | 12 |

GRAPHICS DISPLAY SYSTEM FUNCTION CIRCUIT

DESCRIPTION

Cross Reference To Related Copending Applications

U.S. patent application Ser. No. 07/013,842 entitled "High Resolution Graphics Display Adapter" filed Feb. 12, 1987, relates to an overall high function video display adapter in which architecture of the present invention has particular utility.

U.S. patent application Ser. No. 07/013,848 filed Feb. 12, 1987, entitled "Vector Generator With Direction Independent Drawing Speed For An All Point Addressable Raster Display" discloses a novel vector line drawing circuit for use with raster scan type video displays and having both improved speed and versatility of function.

U.S. patent application Ser. No. 07/013,847 filed Feb. 12, 1987, entitled "Pixel Data Path For High Performance Raster Displays With All Point Addressable Frame Buffers" discloses a channel architecture which could be utilized in the data path feeding the frame buffer of such an adapter and which enables a number of versatile pixel data operations within the frame buffer. The hardware of this application would be located within the pel in processor "block" of application Ser. No. 07/013,842.

U.S. patent application Ser. No. 07/013,843 filed Feb. 12, 1987, entitled "A Frame Buffer Capable of Accessing Aligned Square Words of the Screen" discloses a frame buffer architecture which permits a substantial increase in the speed of a number of display operations as well as enhancing the versatility of the adapter in terms of the functions that may be performed off line. The hardware of this application would be located in the "frame buffer" block of application Ser. No. 07/013,842.

U.S. patent application Ser. No. 013,840 filed Feb. 12, 1987, entitled "A Memory Array Access Circuit For A High Performance Video Display System" discloses a memory interface for "pel processor" block of application Ser. No. 07/013,842.

U.S. patent application Ser. No. 07/013,849 filed Feb. 12, 1987, entitled "A Graphics Function Controller For A High Performance Video Display System" discloses circuitry for performing line drawing and bit block transfer operations in the pel processor block of application Ser. No. 07/013,842.

Technical Field

The present invention relates to computer graphics and more specifically to an apparatus using a counting circuit to provide line drawing and bit block transfer graphic functions.

Background Art

The evolution of computer technology has resulted in the creation of a sophisticated technical area devoted to the representation of graphics information generated by computers. This area is termed computer graphics. One technique that is commonly used to produce an image is that of producing a set of points and connecting these points with straight lines. The resulting combination of points and straight lines are displayed on the computer graphics terminal display which normally includes a cathode ray tube (CRT). The cathode ray tube includes an array of picture elements. The graphics image is produced by illuminating selected picture elements of the array. This array of picture elements in a display corresponds to the memory locations in an image memory. This image memory is often termed a bit map memory. The corresponding CRT display is termed a bit mapped display.

A very useful function for bit map displays is the ability to move a rectangular block of illuminated picture elements (pels) from one place in the bit map (or display) to another place and to logically combine two subsets of the image array to produce a third image array. Another useful function is that of drawing lines between two points. The technique often used to draw these lines is disclosed in a text entitled *Fundamentals of Interactive Computer Graphics* by James D. Foley and Andries Van Dam published by Addison Wesley Publishing Company, 1982 and herein incorporated by reference.

Discussions of graphic functions are contained in several IBM Technical Disclosure Bulletins. *IBM Technical Disclosure Bulletin,* Vol. 28, No. 6, November 1985, entitled "Graphic Bit-Blt Copy Under Mask" discloses a system for making bit boundary block transfers of arbitrary shapes within a frame buffer. *IBM Technical Disclosure Bulletin,* Vol. 27, No. 8, 1985, entitled "Raster Graphics Drawing Hardware", describes the application of programmable logic arrays to the design of hardware circuitry implementing graphics drawing algorithms. *IBM Technical Disclosure Bulletin,* Vol. 28, No. 5, October 1985, entitled "Circuit for Updating Bit Map-Memory of A Display Adapter", discloses a circuit for providing bit manipulation flexibility to control picture element data stored in an all points addressable display memory.

It is an object of the present invention to provide a mechanism for rapidly producing an image of a line drawn between two points and for rapidly producing an image involving a transfer of bit block picture element information.

Disclosure of the Invention

In accordance with the present invention, a counter circuit is disclosed that includes a first counter that counts from a first initial state to a first predetermined value and a second counter that operatively connected to the first counter and including a circuit for performing either a first operation that counts from a second initial value to a second predetermined value in response to the first counter counting to its first predetermined value or a second operation that includes the computation of a parameter value and conditionally counting from the second initial value to a second predetermined value in response to the first counter reaching its first predetermined value. The selection of either the first or second operations is specified by a signal from the processing system.

In an embodiment of the system, the second counter circuit conditionally decrements the count in response to the computed value of the parameter in the second counter. In this embodiment, the counter circuitry is used to provide addresses for either a line drawing algorithm or a bit block transfer algorithm for display processing. To implement the bit block transfer algorithm, the first counter and second counter are effectively combined to perform an inner loop and outer loop counting sequence where the first counter counts from its first initial state to its first predetermined value (the inner loop) and the second counter counts from its second initial value to its second predetermined value (the outer loop). The counter circuit also performs a line draw algorithm function where the algorithm requires a conditional incrementing of a count in response to the state of an error term to be computed upon a first counter count. The second counter circuitry includes the capability to determine the state of this predetermined error term in order to determine whether or not the second count is decremented accordingly.

Also in this embodiment, the counters are connected to a clocking circuit to provide a clocking cycle signal for incrementing counts. The counters are connected to addressing registers to increment the addresses in accordance with the line draw algorithm or bit block transfer algorithm. This connection to the addressing registers is reconfigurable by the processor to interchange connections between address registers and counters. This capability enhances the performance of the line drawing algorithm and the BITBLT algorithm by allowing lines in all octants to be drawn or BITBLT's in any direction to be executed.

BRIEF DESCRIPTION OF THE DRAWING

The novel features believed characteristic of the invention are set forth.. in the appended claims. The invention itself, however, as well as other features and advantages thereof, will be best understood by reference to the following description of the preferred embodiment, when read in conjunction with the accompanying figures, wherein:

BEST MODE FOR CARRYING OUT THE INVENTION

This invention relates to a counter circuit for a data processing system. The counter circuit is included in a picture element processor that provides graphics data to a high resolution graphics display.

This invention is included in a computer terminal display adapter circuit. This adapter circuit is a high resolution graphics display adapter that in the preferred embodiment drives an IBM 5081 display monitor unit. This circuit provides a resolution of 1024 by 1024 picture elements with 256 simultaneous colors from a palette of 4,096 possible colors. A general description of this display adapter circuit follows.

Display Adapter—General Description

Figure 1:
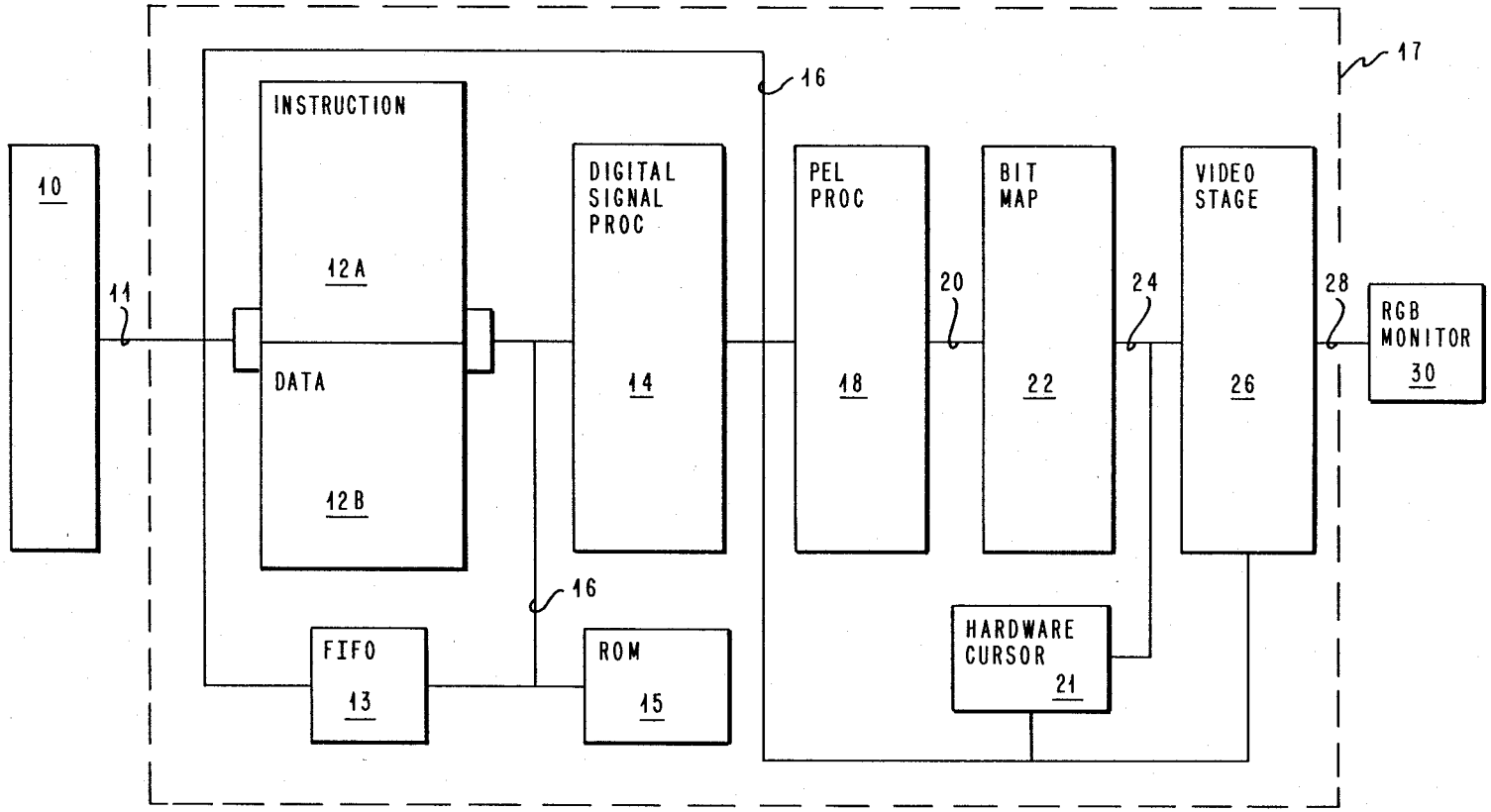
FIG. 1 is a block diagram illustrating a display adapter circuit connected to a processor and monitor.

FIG. 1 is a block diagram illustrating the display adapter circuit 17 connected for operation. Specifically, display adapter circuit 17 is connected to a system processor 10 by a system I/0 bus 11. Additionally, the adapter circuit 17 is connected to a RGB monitor 30 by an output bus 28. The display adapter circuit 17 includes two memories 12A and 12B that are connected to a digital signal processor which is used for circuit resource management and is further used to transform coordinates. In the preferred embodiment, the digital signal processor is of a Harvard architecture requiring separate memories for data and instructions. Memory 12A is an instruction RAM that is loaded with microcode to provide instructions to the signal processor 14. The memory 12B is a data RAM that provides a primary interface between the signal processor 14 and the system processor 10 and also forms the main data store for the signal processor 14. In the preferred embodiment, 256K bytes of memory are provided for memory 12B. In this embodiment, however, the digital signal processor 14 has an address space of only 128K bytes. Therefore, a bank switching mechanism is provided. Furthermore, in this preferred embodiment memory located outside of the adapter circuit 17 may be mapped into the digital signal processor 14 address space.

A first-in, first-out buffer 13 is provided for passing sequential display commands from the date memory 12B to the digital signal processor 14. Further, an instruction ROM 15 is connected via bus 16 to provide the power on and self-test instruction microcode programs for the digital signal processor 14.

A pel (picture element) processor 18 is also connected to bus 16. The function of the pel processor 18 is to draw lines, provide for manipulation of areas of data on the display screen and provide bit map memory control. This manipulation of areas on the display screen is termed bit block transfer or BITBLT. The pel processor 18 also includes control and status registers that along with other functions allow the system processor 10 to interrupt, disable or reset the signal processor 14 and allow the signal processor 14 to interrupt the system processor 10.

The pel processor 18 is connected via bus 20 to a bit map memory 22. The bit map memory 22 is organized as 1024 by 1024 by 8 bits. The bit map memory 22 also includes the capability to provide an overlay plane that can be used to provide blinking or highlighting to data on the display.

A video stage 26 is connected to the bit map memory 22 via bus 24 and transforms the data in the bit map memory 22 into a video signal for the video monitor 30. This video stage 26 provides this transformation via a digital to analog circuit. A color palette circuit is also included in the video stage 26 that provides 256 simultaneously displayable colors from a larger palette of colors. This is accomplished through video lookup tables that translate the value in the bit map to a value with more bits and thus a greater range of colors is provided. With this greater range of values provided by the color palette, more colors are provided than would be provided by use of the bits in the bit map memory 22 alone.

A hardware cursor 21 is connected to the video stage 26 via bus 24 and provides a full screen cross hair and/or a bit programmable cursor. The full screen cross hair can be programmed to one of several widths. In addition this cross hair can also be scissored (reduced in size) to provide various smaller sizes.

In the preferred embodiment, the display adapter circuit 17 uses the digital signal processor 14 as a primary interface to the system processor 10. In this embodiment, the digital signal processor is a Texas Instruments TMS 32020 digital signal processor which executes 5 million instructions per second. Therefore, it is well suited to perform such tasks as matrix multiplications which are used to translate, scale and rotate vectors on the screen. The digital signal processor can address a data space of 64K of 16 bit words and an instruction space of the same size. As mentioned earlier, a portion of the data space may be located within the adapter circuit 17 or remote from the adapter circuit 17. The digital signal processor 14 can be interrupted by the signal processor 10 or by the pel processor 18. The pel processor 18 can generate interrupts to the digital signal processor 14 or the system processor 10 upon the occurrence of a task complete condition or the condition where a vertical retrace has been started. In addition, the digital signal processor 14 also includes a timer which can be used to control the time between display updates.

The ROM 15 is provided with the initial power-up instruction sequence for the digital signal processor 14. In the preferred embodiment, the ROM 15 is provided with 16K bytes of information and includes a power-on self-test program and a graphics display adapter emulation program. The power-on self-test program provides an indication that immediately after a power-up condition or a reset condition that the adapter circuit 17 is functioning properly.

The data RAM 12B provides 256K bytes of RAM in the adapter circuit 17 for the signal processor 14 to use as storage. 1K byte of the 256K byte data space is overlayed by the signal processor 14 internal registers. The data memory 12B consists of dynamic RAM, which is refreshed by logic within the display adapter circuit 17. This memory is operated in a page mode so that accesses to two words loaded on the same page (i.e., in the preferred embodiment in the high order 8 address bits) will require no wait states for the digital signal processor 14. Accesses to words on a new page will result in a single wait state. Thus, locating frequently referenced data in internal registers or grouped together on a single RAM page will increase performance by not incurring any wait states. Although the digital signal processor 14 data addressing capacity is limited to 64K words, a bank switching mechanism is provided to extend its address space. This scheme allows a full access to the data memory 12B. Presently, four banks (64K bytes for each bank for a total of 256K bytes) have been implemented. However, the address logic in architecture may provide for up to 16 banks in this preferred embodiment. In this embodiment, the RAM is dual ported, that is the system processor 10 and the signal processor 14 have concurrent access to it. Since both processors 10 and 14 have easy access to this memory, it provides for a convenient communications channel between the two processors 10 and 14. In this embodiment, the signal processor 14 can also address memory located remote from the display adapter circuit 17 as an extension of this data RAM 12B, by first acting as a first party bus master on bus 11. Both memory on the I/O bus 11 and within the system processor's 10 main memory may be accessed in this manner. The signal processor 14 can put a full 24 bit address on bus 11 and so has a potential of addressing 16 megabytes of memory. The mapping of data space remote from the adapter circuit 17 is controlled by a Bank/Extended Address Register within the signal processor 14. The 16 bit address bus of the signal processor 14 is extended to 24 bits with this register. Access may be made in burst mode, buffered mode, or singly. The length of the burst in burst mode is software controllable. Four to sixteen wait states are required for access to remote memory.

The instruction memory 12A provides 128K bytes of memory in the preferred embodiment to the digital signal processor 14 to use as an instruction space. This is in addition to the instruction space provided by ROM 15. However when the ROM 15 is mapped into an instruction space, it overlays an equivalent amount of instruction RAM 12A. This is done because the digital signal processor 14 can only address a total instruction space of 128K bytes. The instruction memory 12A consists of dynamic RAM which is refreshed by logic on the adapter circuit 17. The instruction RAM 12A is operated in a page mode so that access to words located on the same page (i.e., the high order 8 bits) requires no wait states for the signal processor 14. Accesses to a new page results in one wait state. Therefore, locating frequently executed code loops on the same page within the instruction memory 12A or within the signal processor 14 internal instruction memory will provide a maximum execution speed. This instruction memory 12A is also dual ported providing concurrent access from the system processor 10 or the signal processor 14.

The FIFO buffer 13 is 1K words in length. When there is space in buffer 13, the system processor 10 may load commands and/or data into this buffer providing access to the digital signal processor 14 which can then sequentially access this information. In this embodiment, display information from the system processor 10 is provided. The buffer 13 includes three flags: empty flag, half full flag and full flag which can be read by the system processor 10 to determine if there is room to write more information into this buffer 13. In addition to the flags, this buffer 13 has three interrupts associated with it. A half full interrupt, a half empty interrupt and a buffer overflow interrupt are provided. The first two may be used to pace write operations to the buffer 13 without polling the flags, while the last would normally be considered an error condition. The digital signal processor 14 also has access to the flags to determine if more information can be read from the buffer 13.

The pel processor 18 assists the signal processor 14 in updating the bit map memory 22 quickly. The pel processor 18 can either draw lines into the bit map memory 22 or manipulate rectangular blocks of data bits (BITBLT) in the bit map memory 22. When line drawing, the pel processor 18 can either be given the end points of the line, with Bresenham's parameters calculated by the pel processor 18, or the end points along with the parameters needed by the Bresenham's incremental line drawing algorithm. The latter approach allows more control over the vector to raster translation and may be useful for special cases such as wide lines. In addition, line attributes of color and pattern are supported directly by the pel processor 18. Support of the line width attribute requires some intervention by the signal processor 14. Lines may be drawn in replace mode, exclusive OR mode, or line on line mode.

Bit block transfers are also performed by the pel processor 18. Some of the bit block transfers operate with minimal processor intervention while others require more intervention. The bit block transfer includes the operation of an inner loop and an outer loop and the implementation in this embodiment provides that the inner loop may be either horizontally or vertically oriented. This option is particularly useful when transferring images of character strings to the bit map memory 22. In addition, the pel processor 18 has the ability to provide bit block transfers with color expansion. Color expansion is defined as the process of taking data in which each active bit represents a pixel of a known color and a zero indicates transparency (i.e., the frame buffer is not altered for this pixel location). This mode offers a performance advantage as each word of data represents 16 pixels of screen memory rather than 2.

When using color expansion, a special feature associated with the Direct Write Mask, a capability of the pel processor 18, allows the object being transferred to be rotated in any one of four possible 90 degree orientations.

The digital signal processor 14 or the system processor 10 can define an active region of the bit map memory 22 where drawing occurs*. For line draw and block transfer operations, only pels that are to be drawn in this active region will be written to the bit map memory 22. Line draw and block transfer operations resulting in drawing outside of this area will be performed but the resulting pel information will not be written to the bit map memory 22. The use of this active drawing region is termed scissoring.

A further feature of the pel processor 18 is the pick window. This window can be defined to the pel processor 18 and when enabled any access to the frame buffer within this window causes an interrupt to the signal processor 14. This can be used while drawing objects to identify any part of the object which falls within the specified window.

The pel processor is normally controlled by the signal processor 14, however, the system processor 10 may disable the signal processor and control the pel processor 18 directly. The pel processor 18 will be discussed in more detail later.

The bit map memory 22 consists of 1 megabyte of video RAM. The bit map memory 22 is displayed on the screen as a 1024 by 1024 pel image with 8 bits per pel. The pel processor 18 acts as the interface between the system processor 10 or signal processor 14 and the bit map memory 22. Depending upon how some of the bits located within the pel processor 18 are set, the bit map memory 22 will be read as either two horizontally adjacent pels or four horizontally adjacent half pels (wherein a half pel is defined as either the first four or last four bits of a full pel). In all addressing modes, the bit map memory 22 is pel addressable. That is, X and Y address registers in the pel processor 18 are used to indicate the pel being addressed. The present invention incrementally computes the addresses for these registers.

Figure 2:
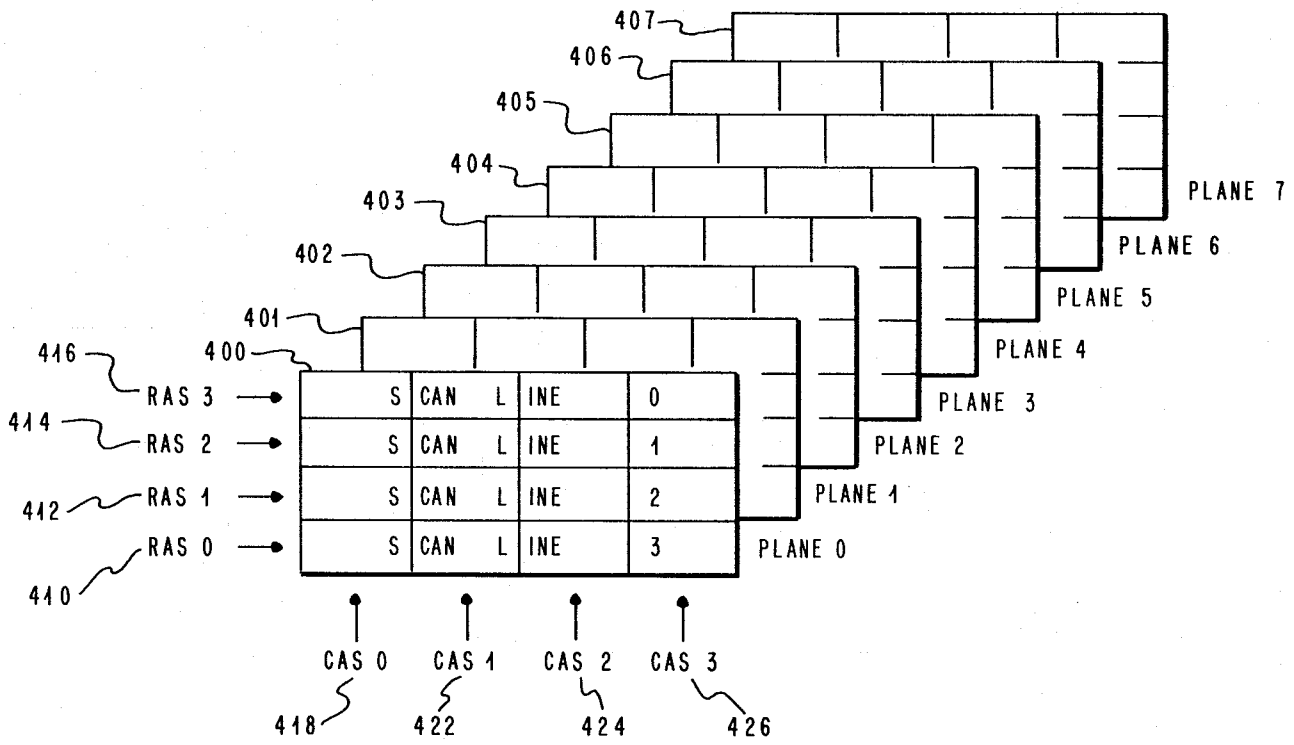
FIG. 2 is a diagram illustrating the organization of the bit map memory 22.

The organization of the bit map memory 22 is shown in FIG. 2. The pels are arranged in 4×4 squares. Each pel is 8 bits deep. The 8 bits represent 8 planes 400 through 407. Pel memory modules on the same rows share a common row address strobe (RAS) line. Those in the same column share a common address strobe (CAS) line. The same address lines are shared by all the pel memory modules. Both the serial data lines used to refresh the screen and the parallel data lines used to read and write the bit map are connected in columns. Thus, data can be read from one of four layers and loaded into accumulators. Each of the 16 pel memory modules in the 4×4 array has its own write enable that is controlled by the direct mask register and the Bresenham line drawing circuits in the pel processor 18.

Figure 3:
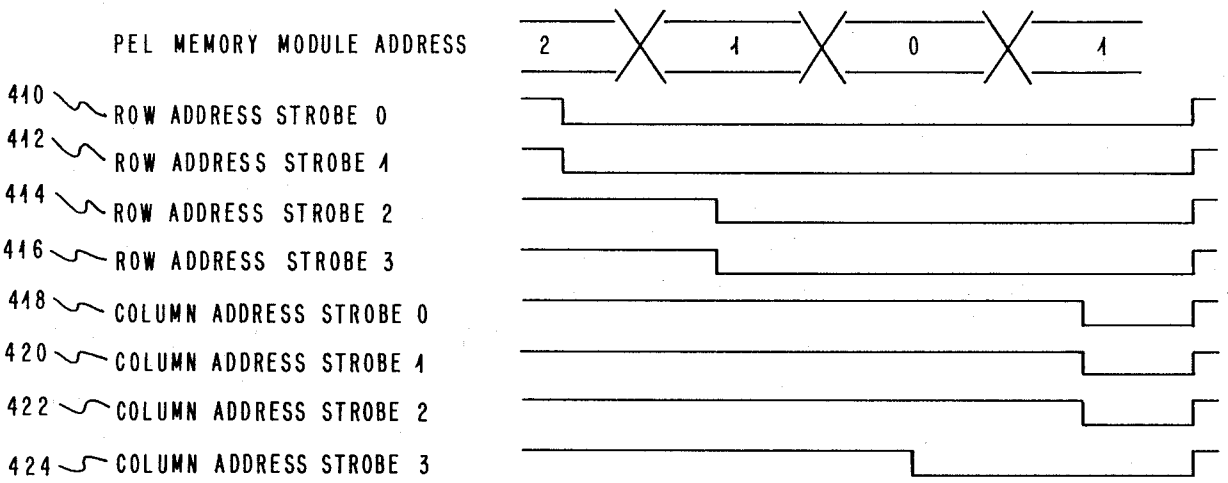
FIG. 3 is a timing diagram illustrating the timing control signals provided to the bit map memory 22 from the pel processor 18.
Figures 4, 5:
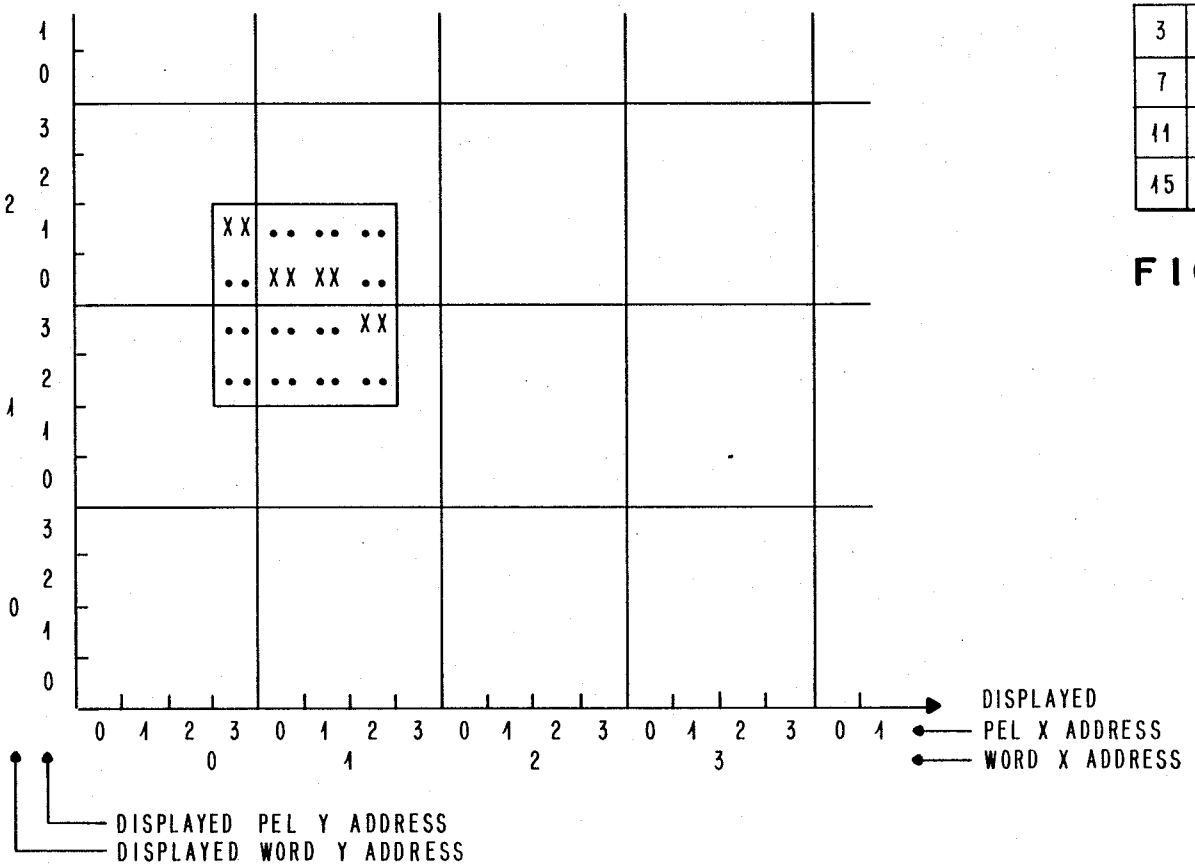
FIG. 4 is an illustration of a portion of a display screen illustrating the display of a 4×4 pel matrix upon a grid display.
FIG. 5 illustrates the address convention for a 4×4 pel matrix.

The multiple RAS lines 410, 412, 414, and 416 and the multiple CAS lines 418, 420, 422, and 424 are used to strobe different addresses in the pels. This allows the "access" 4×4 square word that is addressed by the X and Y pel address registers to be misaligned with the displayed words that are scanned onto the screen. FIG. 3 shows the waveforms for the RAS lines 410, 412, 414, and 416 and the CAS lines 418, 420, 422, and 424 that are used to strobe the addresses into the pel memory 22 and align the access word with respect to the displayed words. Note that this pel alignment of 4×4 words allows a corner of the square to be placed at the start of any line being drawn and, because each pel memory module has an independent write enable, 4 pels of the line can be drawn simultaneously as illustrated in FIG. 4. FIG. 5 illustrates the numbering of the pels in the 4×4 array.

An overlay plane, actually plane 7 (407 in FIG. 2) of the bit map memory 22 can be used in conjunction with the color palette feature of the video stage 26 to provide highlighting or blinking at a programmable rate. With blinking enabled any pixel with a 1 in this plane will blink at the programmable blink rate. With highlighting enabled a 1 in the overlay plane overrides the normal color palette process in the video stage 26 and substitutes a color from a three entry overlay color palette. Note that the use of the overlay plane will effectively reduce the available colors for the color palette feature in the video stage 26.

Returning to FIG. 1, the video stage 26 includes a color palette feature. The color palette translates the 8 bit value stored in the bit map memory 22 into one of 4,096 colors. The output of this color palette feature provides 4 bits to each of 3 digital to analog convertors. The digital to analog convertors in turn drive the red, green and blue color guns of the monitor 30. Each 4 bit section of the look-up table maps the 8 input bits from the bit map into one of sixteen analog output levels. The color palette feature may be loaded by the signal processor 14 or when the signal processor 14 is disabled, by the system processor 10.

The hardware cursor 21 provides a full screen cross hair and/or a 64×64 user programmable cursor. The full screen cross hair can be programmed to one of several widths and scissored. The output of the hardware cursor is fed to the color palette feature of the video stage 26.

In FIG. 1, the system processor 10 provides high level graphics orders to the signal processor 14. Status and other information is passed from the signal processor 14 to the system processor 10. The signal processor 14 breaks down the high level graphics orders from the system processor 10 into a series of low level graphics commands which are then passed to the pel processor 18 via the input bus 16. This input bus 16 includes address, data and control information. If the signal processor 14 has been disabled, the system processor 10 can transfer low level commands and retrieve data directly from the pel processor 18 by means of the input bus 16. Access to the bit map memory 22 is controlled by the pel processor 18. The accesses to the bit map memory 22 take place over bus 20 which provides address data and control information.

Pel Processor—Description

Figure 6:
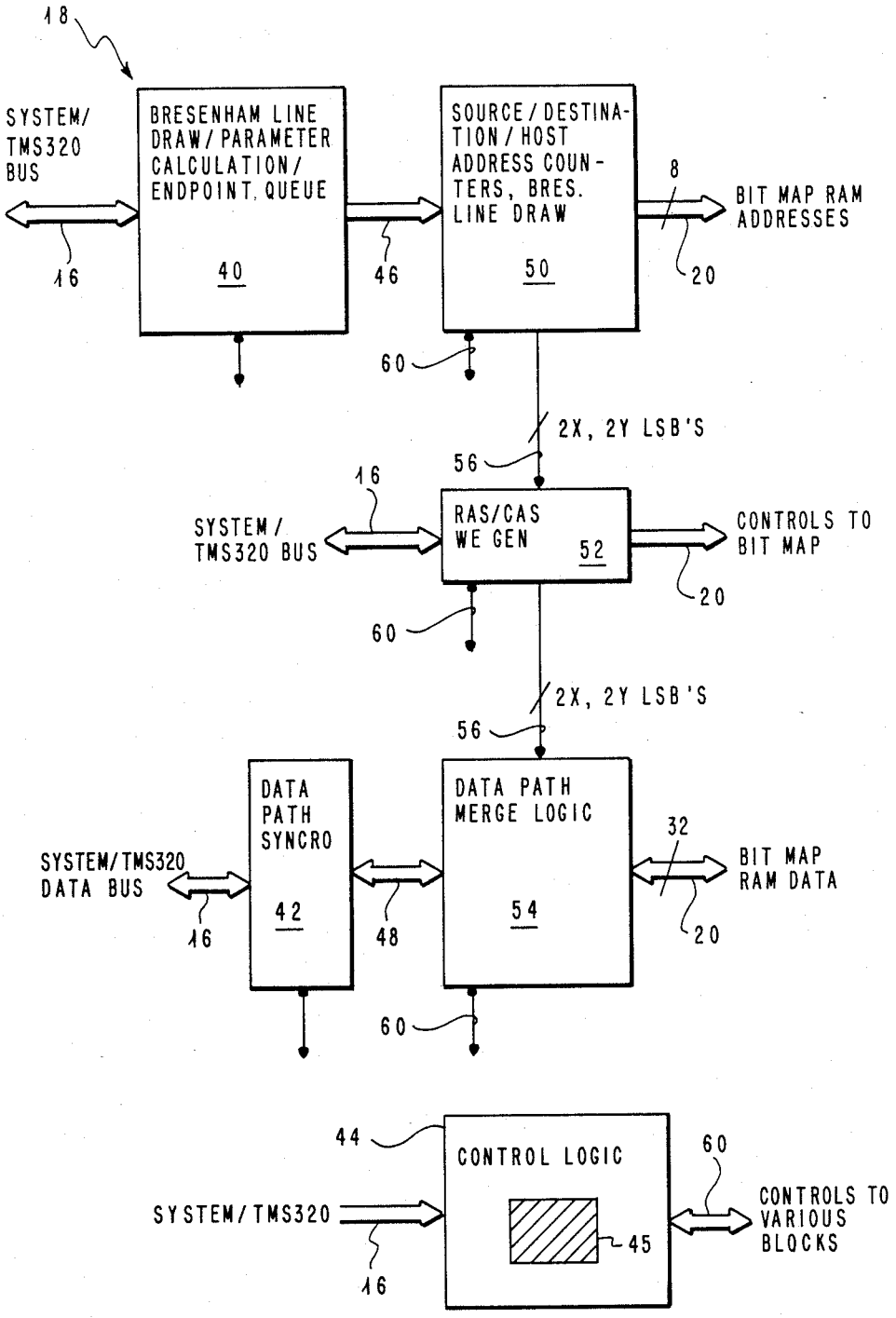
FIG. 6 is a block diagram of the pel processor 18.

A block diagram of the pel processor 18 is shown in FIG. 6. Control of the bit map memory 22 in execution of low level graphics command is achieved by writing control parameters from either the system processor 10 or the signal processor 14 into the pel processor control logic 44 via the input bus 16. These parameters are decoded within the dynamic control mechanism 45, generating control and timing signals for the other parts of the pel processor circuitry and which are provided via line 60. The endpoint address information for a low level order is communicated to the pel processor 18 by the pel processor input bus 16 and stored in the input queue contained in the endpoint logic 40. Depending on the order being processed (either line draw or bit block transfer), various operations are performed. If a line draw order is being executed, the endpoint data is used to calculate parameters used in executing Bresenham's line draw algorithm in the address count logic circuitry 50. For block transfer operations, the endpoint logic 40 simply queues the input data until this data can be transferred to the address count logic 50. Communications of the endpoint and line draw parameters from the endpoint logic 40 to the address count logic 50 takes place over the address/parameter bus 46. When these parameters have been loaded into the address count logic 50, the endpoint logic 40 is free to accept new endpoint data for the next graphics order. The address count logic 50 includes a portion of the present invention and uses the parameters to generate the bit map addresses needed to complete the order being executed, and, in addition uses some parameters to sequence the task and determine when the task has been completed.

The address count logic 50 manipulates coordinates in 10 bit fields. The upper 8 bits of the field form the bit map memory addresses 20. The lower 2 bits of both the X and Y coordinates are passed to the RAM control logic 52 via the pel bus 56 where they are decoded into bit map control signals on line 20. These bits are also passed to the data path merge logic 54 via the pel bus 56 where they are used to control data being stored into or retrieved from the bit map memory 22. The data path merge logic 54 serves as the bridge between the system and display processor buses and the bit map memory data bus 20. System processor 10 data can be transferred between or combined with bit map data using the merge logic 54. Data being transferred to and from the system processor 10 is controlled by the data path synchronization circuitry 42 and passed via the merge bus 48.

Figure 7A:
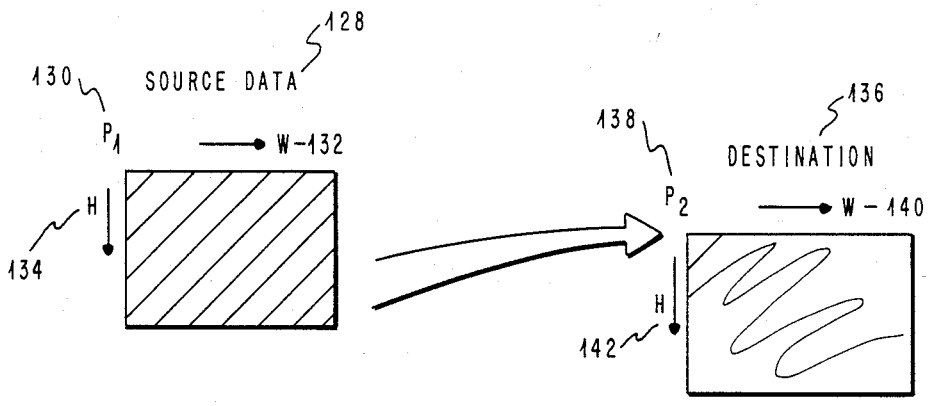
FIG. 7A illustrates a bit block transfer function.
Figure 7B:
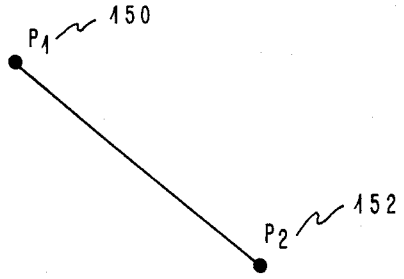
FIG. 7B illustrates a line draw function.

The following is a more detailed explanation of the two main graphics tasks that are performed by the pel processor 18. These two tasks are illustrated in FIGS. 7A and 7B. The bit block transfer task (FIG. 7A) consists of moving rectangular blocks of data from a source area of the bit map memory 22 to a destination area of the bit map memory 22. This task is commonly used to "scroll" information on the screen or to display a pop-up menu. Line drawing (FIG. 6B) which consists of connecting two points in the bit map memory 22 via straight line, is also a commonly used function. Both of these tasks form the foundation of higher level graphics operations, such as multiple source bit block transfers, pattern lines, polygon drawing, etc. For this reason, it is essential to perform these base functions as effectively as possible.

In FIG. 7A, it is desired to move a data block from location 128 to location 136. In order to perform a bit block transfer from the source location 128 to the destination location 136, the following sequence of events must take place within the pel processor 18. Once the pel processor 18 control logic 44 (FIG. 6) is loaded with control parameters to perform a bit block transfer operation, the endpoint data for P1 (130) and P2 (138) along with the height parameter (134) and the width parameter (132) are loaded into the endpoint logic 40 (FIG. 6). In executing a bit block transfer operation, the endpoint logic serves as an intermediate level of storage, passing the parameters to the address count logic 50 (FIG. 6) when the task is initiated. Loading the Y address value of P2 (138) signals the pel processor 18 to begin task execution. At this point, the address and parameter counters within the address count logic begin to access the bit map memory locations along with the width dimension of the bit block transfer, alternately accessing the source, then the destination addresses. When a string of accesses is completed along the width dimension, the address counters are automatically counted and reloaded to begin the next line. This process continues until the bottom of the bit block transfer is reached. The address counters generate a 10 bit pel address, and the upper 8 bits are used as the bit map memory address 20, while the lower 2 bits 56 are used as the pel decode in the RAM control logic 52 (FIG. 6), and the merge logic 54. The merge logic 54 takes the data read in from the source location, aligns it, and passes it out to be stored in the destination locations.

FIG. 7B illustrates a line draw task. In order to perform a line draw command, the end points of the line, P1 (150) and P2 (152) are loaded into the endpoint logic 40 (FIG. 6). Loading the Y address value of P2 (152) signals the pel processor 18 to begin execution. At this point, the endpoint logic begins to calculate the various Bresenham parameters associated with the line to be drawn. Once this calculation process is finished, the parameters are passed to the address count logic 50. To execute this line draw task, the address count logic will begin generating pel addresses for each pel in the line. The upper 8 bits of the address will serve as the bit map address 20 as before. The lower 2 bits 56 of the pel address are passed to the RAM control logic 52, where they are used to generate the appropriate write enables to draw the line into the bit map.

Figure 8A:
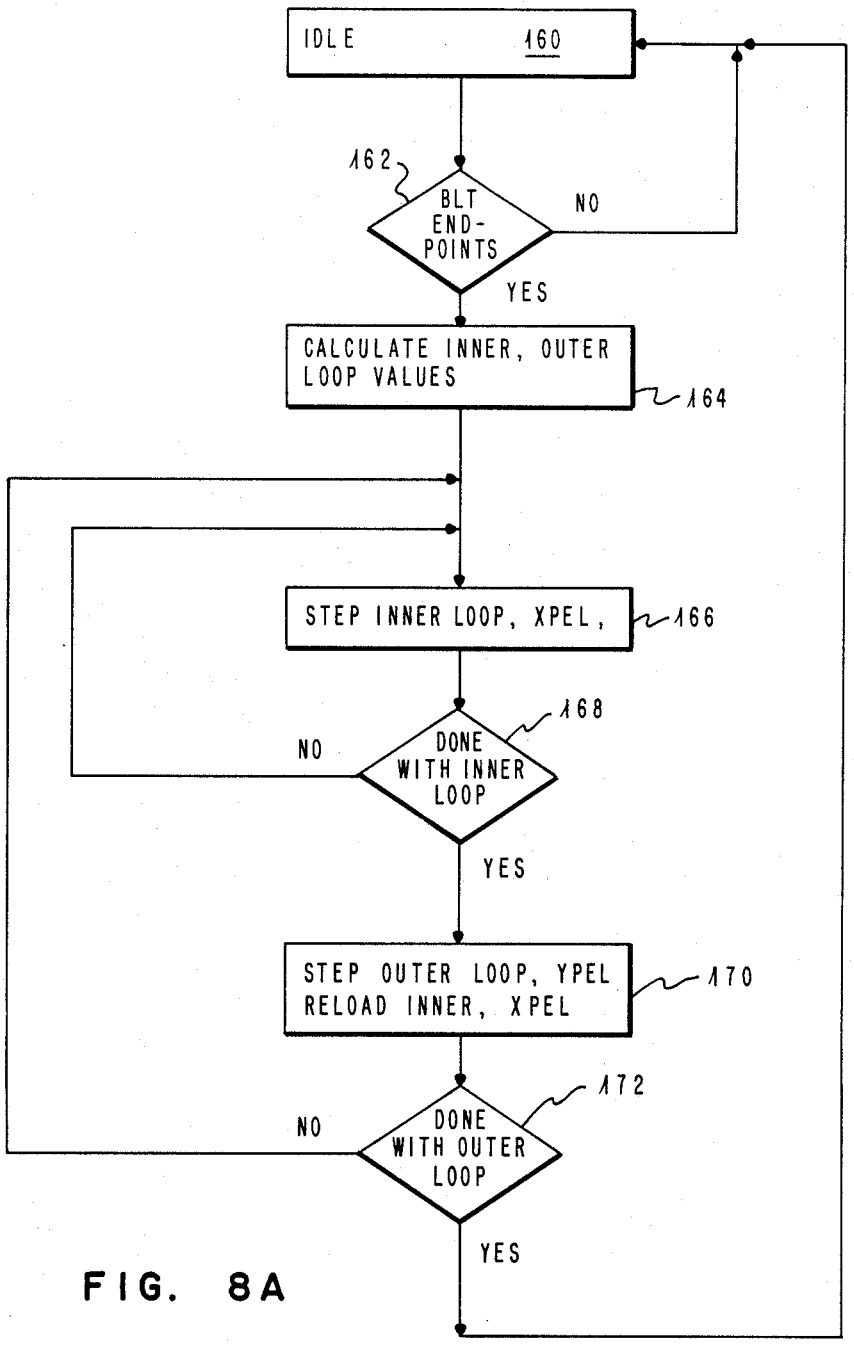
FIG. 8A is a flow diagram for the bit block transfer function task.

FIG. 8A is a software flow diagram illustrating the bit block transfer function. The pel processor 18 is in the idle state 160 until it receives the bit block transfer end points as illustrated in step 162. If the end points have not yet been received, the pel processor 18 remains in a idle state 160 searching for the end points. When the end points have been received, the pel processor 18 proceeds to step 164 to calculate the inner and outer loop values. In 166 the inner loop incrementing begins with the X pel address being incremented. In step 168 a decision is made as to whether or not the inner loop has been completed. If the inner loop has not been completed, the processor 18 returns to step 166. If the inner loop has been completed, the processor 18 proceeds to step 170 to step the outer loop set the Y pel and reload the inner loop counter. In step 172, a decision is made as to whether or not the outer loop has been completed. If the outer loop has not been completed, then the pel processor 18 returns to step 166. If so, the pel processor 18 returns to the idle state 160.

Figure 8B:
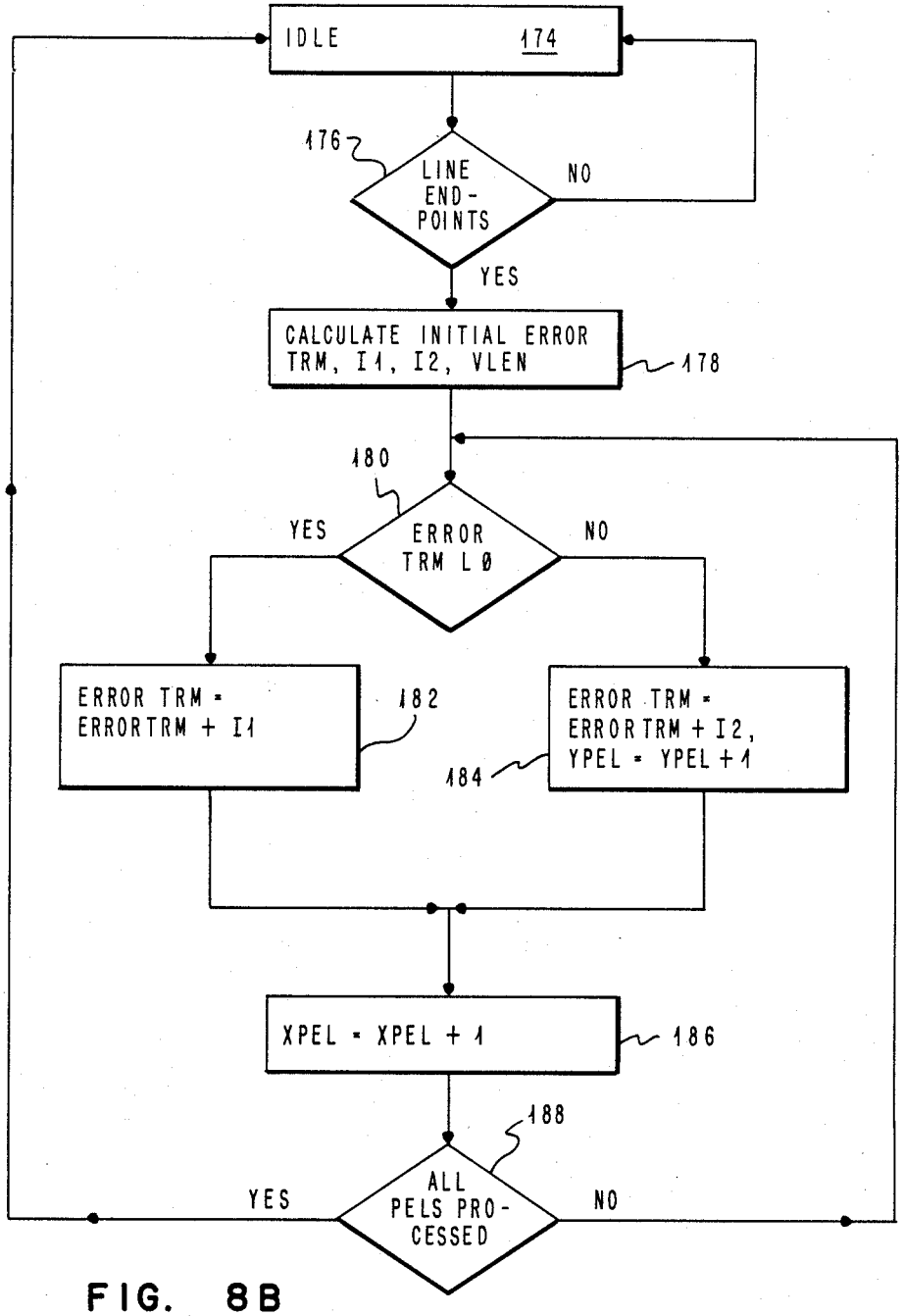
FIG. 8B is a flow diagram for the line draw task.

FIG. 8B illustrates a flow chart for the Bresenham line draw algorithm. The Bresenham algorithm is disclosed in the *Fundamentals of Interactive Computer*

*Graphics* by James D. Foley and Andries Van Dam, published by Addison Wesley Publishing Company, 1982 and appearing on pages 433–435. An over simplified explanation of the Bresenham algorithm is that it determines which picture elements in an array of picture elements should be illuminated to represent an approximation of a straight line in this array of picture elements. Basically the algorithm uses the slope between the two endpoints to determine a set of parameters that are used to designate which pels are to be activated. In FIG. 8B, the pel processor 18 initially loops between an idle state 174 and a decision state 176 until the line endpoints have been received. When the line end points have been received, the processor 18 proceeds to step 178 to calculate an initial error term, I1, I2, and the line length. The processor 18 then proceeds to step 180 to determine if the error term is less than 0. If not, the pel processor 18 proceeds to step 184 where the error term is added to I2 and the Y pel address is incremented. The pel processor 18 proceeds to steps 186 to increment the X pel. A decision is made in step 188 to determine if all the pels have been processed. If not, the processor 18 returns to step 180 to examine the error term. If the error term is less than 0, then the processor 18 proceeds to step 182 to add the constant I1 to the error term. The pel processor 18 then proceeds to step 186 as before. When it is determined that all the pels have been processed (step 188), the processor 18 returns to the idle state 174. It should be understood that the slope of the line to be drawn and its direction will determine which address counter is being conditionally counted.

Figure 9:
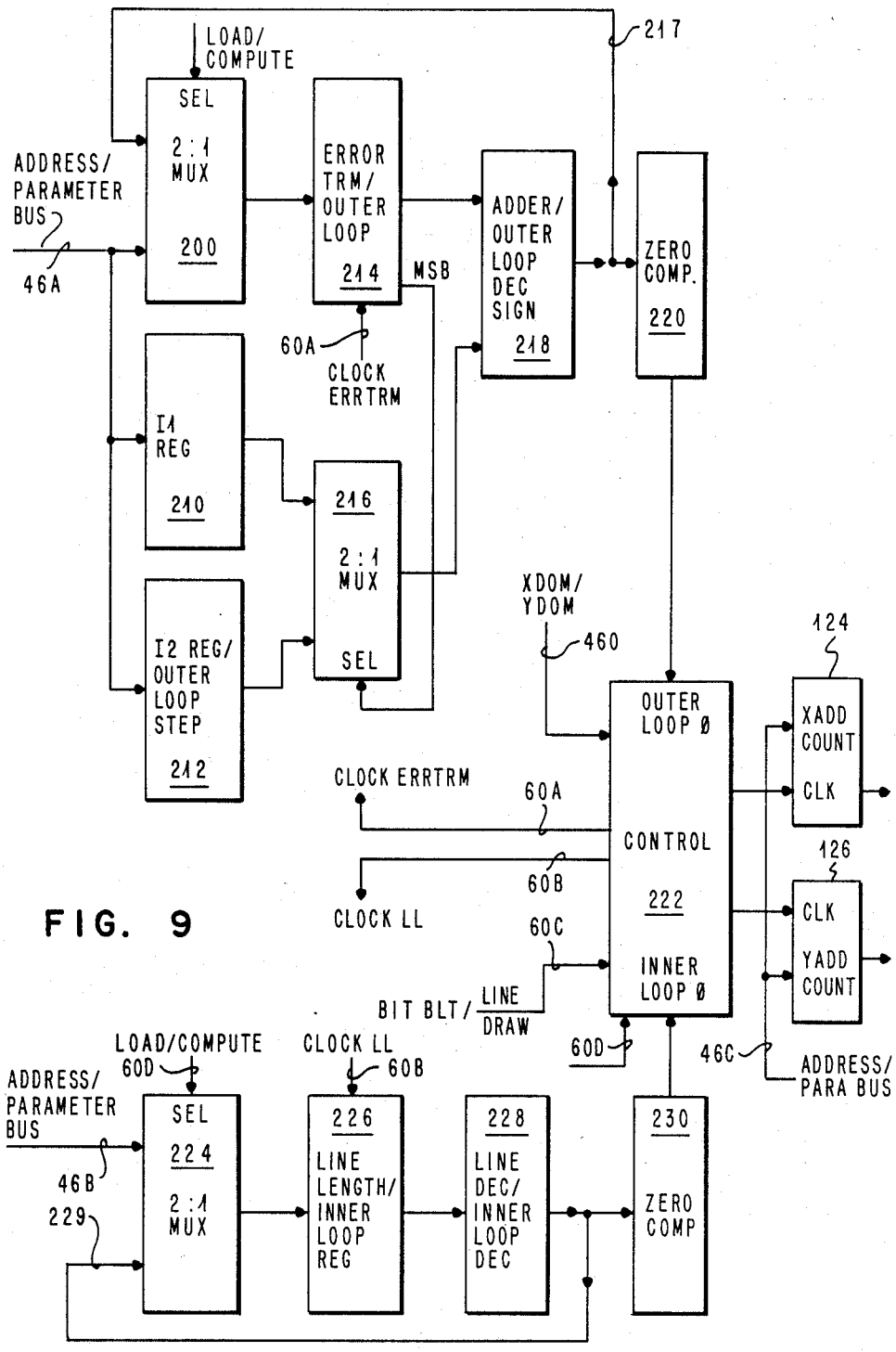
FIG. 9 is a block diagram of the pel processor 18 memory addressing circuit.

A block diagram for a dual purpose line draw/bit block transfer circuit is shown in FIG. 9. Specifically this circuitry includes two counters that implement portions of either the line draw algorithm or the bit block transfer algorithm. The first counter includes a multiplexor circuit 224 connected to a register 226 and connected to a decrementing circuit 228. Decrementor 228 is connected to both a zero compare circuit 230 and to the multiplexor circuit 224 by a line 229. The output of the zero compare circuit 230 is provided as an inner loop count to control circuitry 222. In operation, register 226 contains the line length parameter in the line draw function and an inner loop count in a bit block transfer function. Decrementing circuit 228 decrements either the line count or the inner loop count during a counter operation. The counting operation is performed upon the occurrence of a clock cycle provided by line 60B to the register 226. Register 226 is initialized from multiplexor 224 that is controlled by line 60D to provide the address on the address bus 46B to register 226 or to loop the results from decrementor circuit 228 to register 226. When the output of the decrementor circuit 228 reaches 0, the zero compare circuit 230 provides a signal to the control circuit 222.

A second counter is provided that consists of multiplexor 200, register 214 and circuit 218 which acts as an adder when performing the line draw algorithm and a decrementing circuit when performing the bit block transfer algorithm. Circuit 218 provides an output to the multiplexor 200 by line 217 and to the zero compare circuit 220. When performing a bit block transfer, multiplexor 200, register 210 and circuit 218 perform as a simple counter decrementing a count each time the first counter consisting of circuits 224, 226 and 228 reach 0. The counter is initialized from the address bus 46A connected to the multiplexor 200 which loads this address on address bus 46A to the register 214. Register 214 receives a clock signal on line 60A to clock the second counter configuration. When executing the line draw algorithm, the Bresenham parameters are input to registers 210 and 212. The Bresenham initial "error term" is loaded by the multiplex circuit 200 into register 214 from the address bus 46. Likewise, the line length is loaded into the register 226 by multiplexor 224 from the address bus 46B. The address bus 46C loads the X address counter 124 and the Y address counter 126. The X address counter 124 and Y address counter 126 contain the starting X and Y addresses for the function to be executed. Once the initial loading process has been completed, control circuitry 222 clocks the registers 214, 226, 124 and 126 until the task is completed.

Figure 10:
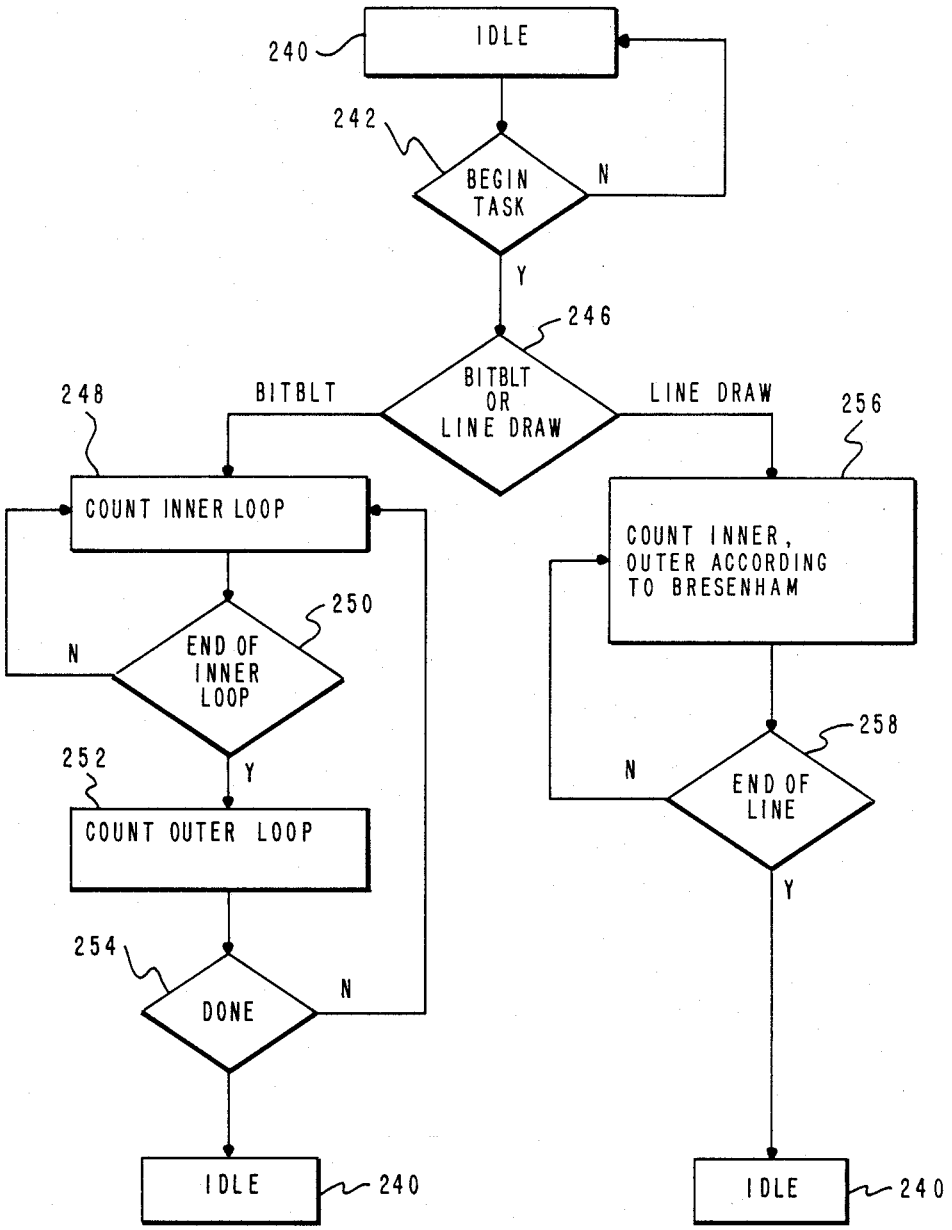
FIG. 10 is a flow chart illustrating the operation of the pel processor 18 control circuitry to perform either a bit block transfer operation or a line drawing operation.

FIG. 10 illustrates a flow chart of the operations of the control circuitry 222. Normally the control circuitry 222 is in either state 240 or state 242 determining if a task needs to be initiated. If no task is to be initiated, the control circuitry 222 continues in this loop. When a signal is received on line 60D (FIG. 9), the control circuitry 222 leaves task 242 and enters step 246 which requires a decision as to which algorithm to be performed, i.e., either a bit block transfer or a line draw. This determination is made as a result of the signal on line 60C. When performing a bit block transfer, the control circuitry 222 counts the inner loop portion in step 242 with decision step 250 until the end of the inner loop has been counted. When the inner loop has been counted, the control circuitry 222 enters step 252 to count the outer loop. Decision step 254 determines if the outer loop has been completed. If not, then the control circuitry reinitiates the next inner loop count in step 248. When the inner loop and outer loop counting has been complete, the control circuitry 222 reenters the idle state 240.

In performing a line draw function, step 256 is entered. In step 256 the inner loop count (counting in register 226 of FIG. 8) continues as with a bit block transfer function. However, the count in register 214 is provided as a result of the Bresenham algorithm. Step 258 determines when the counting in registers 226 and 214 has been completed. If not, the control circuitry 222 loops back to step 256. When the function has been completed as determined by step 258, the control circuitry 222 reenters the idle state 240.

Although this invention has been described with reference to this specific embodiment, this description is not meant to be construed in a limiting sense. Various modifications of the disclosed embodiment, as well as other embodiments of the invention, will become apparent to those persons skilled in the art upon reference to the description of this invention. It is, therefore, contemplated that the appended claims will cover any such modifications or embodiments as fall within the true scope of this invention.

I claim:

1. In a graphics display system having a processor for performing either a line drawing algorithm or a bit block transfer algorithm, said processor including a counter circuit comprising:

a first counter means for counting from a first initial state to a first predetermined value, and a second counter means operatively connected to said first counter for performing either a first operation for providing addresses to perform a bit block transfer including counting from a second initial value to a second predetermined value in response to said first counter means counting to said first predetermined value, or a second operation for providing addresses to perform drawing a line including computing a parameter value upon the occurrence of a first counter means count and conditionally counting if said parameter value is greater than a preselected value, from said second initial value to said second predetermined value, said first or second operation being specified by a signal from said processor.

2. An addressing circuit in said graphics display system processor according to claim 1, wherein said counter circuit further includes control means connected to the second counter means for receiving said signal from said processor.

3. An addressing circuit according to claim 2, wherein said graphics display system processor includes a clock means for providing a clocking cycle signal to the first and second counter means and wherein any counting by said first or second counter means is performed upon the occurrence of said clocking cycle signal.

4. An addressing circuit according to claim 3, wherein said first and second counter means are connected to addressing computing means for incrementing addresses for either the line draw algorithm or the bit block transfer algorithm in accordance with said signal from said processor.

5. An addressing circuit according to claim 4, wherein said addressing means includes configuration means for providing either a first configuration connecting said first counter means to a first address register and said second counter means to a second address register or a second configuration connecting said first counter means to said second address register and connecting said second counter means to said first address register for incrementing addresses in accordance with the line draw algorithm.

6. In a graphics display processor, an addressing circuit for performing operations in support of either a line drawing algorithm or a bit block transfer algorithm, said circuit comprising:

a first counter;

a second counter; and control means connected to said first and second counters and responsive to an algorithm selection signal from said processor specifying either a line draw task or a bit block transfer task, said control means for configuring said first and second counters to operate as a single counter in response to the selection signal specifying said bit block transfer task or for directing said first counter to count from a first initial value to a first predetermined value, computing a parameter upon the occurrence of a first counter count, and directing said second counter to conditionally count if said parameter value is greater than a preselected value, from a second initial value to a second predetermined value in response to the selection signal specifying said line draw algorithm.

7. A circuit in said graphics display processor according to claim 6, wherein said circuit further includes control means connected to the second counter for receiving said specified operation signal from said processor.

8. A circuit in said graphics display processor according to claim 7, wherein said graphics display processor includes a clock means for providing a clocking cycle signal to the first and second counter and wherein any counting by said first or second counters is performed upon the occurrence of said clocking cycle signal.

9. A circuit in said graphics display processor according to claim 8, wherein said first and second counters are connected to addressing means for incrementing addresses for either the line draw task or the bit block transfer task in accordance with said specified operation signal from said processor.

10. A circuit in said graphics display processor according to claim 9, wherein said addressing means includes configuration means for providing either a first configuration connecting said first counter to a first address register and said second counter to a second address register or a second configuration connecting said first counter to said second address register and connecting said second counter to said first address register.

* * * * *